US007963416B2

(12) United States Patent
Morenstein et al.

(10) Patent No.: US 7,963,416 B2
(45) Date of Patent: Jun. 21, 2011

(54) FOOD PACKAGE WITH LID

(75) Inventors: Joshua Morenstein, San Francisco, CA (US); Vivian Barad, San Francisco, CA (US); Brian Cutter, San Francisco, CA (US)

(73) Assignee: Target Brands, Inc., Minnaepolis, MN (US)

( * ) Notice: Subject to any disclaimer, the term of this patent is extended or adjusted under 35 U.S.C. 154(b) by 251 days.

(21) Appl. No.: 12/112,540

(22) Filed: Apr. 30, 2008

(65) Prior Publication Data

US 2008/0264947 A1 Oct. 30, 2008

Related U.S. Application Data

(60) Provisional application No. 60/914,892, filed on Apr. 30, 2007.

(51) Int. Cl.

| | |
|---|---|
| ***B65D 41/56*** | (2006.01) |
| ***B65D 43/08*** | (2006.01) |
| ***B65D 51/12*** | (2006.01) |
| ***B65D 51/04*** | (2006.01) |
| ***B65D 51/00*** | (2006.01) |

(52) U.S. Cl. ..... 220/376; 220/212; 220/796; 220/213; 220/847; 220/377

(58) Field of Classification Search ..... 220/376, 220/377, 212, 796, 213, 847, 780; 206/459, 206/281, 459.5, 534

See application file for complete search history.

(56) References Cited

U.S. PATENT DOCUMENTS

| | | | | | |
|---|---|---|---|---|---|
| D28,413 | S | | 3/1898 | Taite | |
| 1,884,132 | A | * | 10/1932 | Nelson | 220/348 |
| 2,939,603 | A | | 6/1960 | Young | |
| 3,412,890 | A | * | 11/1968 | Rich | 220/315 |
| 3,417,897 | A | * | 12/1968 | Johnson | 220/254.3 |
| 3,421,654 | A | * | 1/1969 | Hexel | 220/254.3 |
| 3,640,018 | A | | 2/1972 | Light | |
| 3,811,211 | A | * | 5/1974 | Morgan | 40/628 |
| 4,091,927 | A | * | 5/1978 | Lunsford | 206/459.5 |
| 4,360,119 | A | * | 11/1982 | Olivo | 220/522 |
| 4,699,290 | A | * | 10/1987 | Adams | 220/258.2 |
| 4,819,829 | A | | 4/1989 | Rosten et al. | 220/346 |
| D351,087 | S | | 10/1994 | Anderson | |
| 5,392,945 | A | | 2/1995 | Syrek | 220/608 |
| 5,398,908 | A | * | 3/1995 | Kienle | 249/121 |
| 5,427,266 | A | * | 6/1995 | Yun | 220/377 |
| 5,507,389 | A | | 4/1996 | Syrek | |
| D376,952 | S | * | 12/1996 | Rausch | D7/392.1 |
| D389,012 | S | | 1/1998 | Miller | |
| 5,794,768 | A | * | 8/1998 | Skeffington et al. | 206/38.1 |
| D403,582 | S | | 1/1999 | Nask et al. | |
| 5,896,993 | A | | 4/1999 | Nask et al. | |
| D417,584 | S | | 12/1999 | Lillelund et al. | |
| D417,817 | S | | 12/1999 | Loew et al. | |
| 6,079,587 | A | | 6/2000 | Vogt | |
| 6,216,904 | B1 | * | 4/2001 | Cagan | 220/253 |

(Continued)

*Primary Examiner* — Anthony Stashick
*Assistant Examiner* — Kareen Rush
(74) *Attorney, Agent, or Firm* — Griffiths & Seaton PLLC

(57) ABSTRACT

A food package has a container and a lid. The lid includes a planar surface and a convex dome that is above the planar surface. A transparent window in the convex dome attracts the attention of consumers since it is raised relative to the remainder of the lid. The lid also includes a concave dome that frames a raised logo or raised text within the dome. By framing the logo, the concave dome helps to direct a consumer's attention to the logo or text and helps to protect the logo or text from wear.

14 Claims, 7 Drawing Sheets

U.S. PATENT DOCUMENTS

| | | | | |
|---|---|---|---|---|
| D445,687 | S * | 7/2001 | Gilbertson | D9/454 |
| D448,969 | S | 10/2001 | Conti | |
| 6,412,637 | B1 | 7/2002 | Saunders et al. | 206/541 |
| 6,523,713 | B1 * | 2/2003 | Helms | 220/831 |
| 6,568,534 | B2 * | 5/2003 | Zank | 206/508 |
| D480,264 | S | 10/2003 | de Groote et al. | |
| 6,868,980 | B2 * | 3/2005 | Schultz et al. | 220/367.1 |
| D504,053 | S | 4/2005 | Bertulis | |
| 6,910,623 | B2 * | 6/2005 | Stewart et al. | 229/125.19 |
| 6,929,143 | B2 | 8/2005 | Mazzarolo | 220/254.3 |
| D512,914 | S | 12/2005 | Moretti | |
| 7,134,570 | B1 * | 11/2006 | Heath et al. | 220/717 |
| 7,165,695 | B2 | 1/2007 | Choi | 220/258.2 |
| D548,538 | S | 8/2007 | Liu | |
| D550,503 | S * | 9/2007 | Liu | D7/392.1 |
| 7,275,652 | B2 * | 10/2007 | Morris et al. | 220/212 |
| 7,318,536 | B2 * | 1/2008 | Maravich et al. | 220/780 |
| D575,100 | S | 8/2008 | Liu | |
| D589,341 | S | 3/2009 | Busse et al. | |
| 2004/0206765 | A1 * | 10/2004 | McMahon et al. | 220/780 |
| 2005/0092749 | A1 * | 5/2005 | Durdon | 220/254.3 |
| 2005/0224505 | A1 * | 10/2005 | Brown et al. | 220/792 |
| 2006/0181515 | A1 * | 8/2006 | Fletcher et al. | 345/173 |
| 2006/0214417 | A1 * | 9/2006 | Wescott et al. | 283/117 |
| 2008/0264947 | A1 * | 10/2008 | Morenstein et al. | 220/376 |
| 2009/0020546 | A1 * | 1/2009 | Kiehne | 220/796 |

* cited by examiner

FOOD PACKAGE WITH LID

REFERENCE TO RELATED APPLICATION

The present application is based on and claims the benefit of U.S. provisional patent application Ser. No. 60/914,892, filed Apr. 30, 2007, the content of which is hereby incorporated by reference in its entirety

BACKGROUND OF THE INVENTION

Food packaging serves many purposes including protecting food from contamination and spoilage, allowing food to be stacked on shelving in retail stores, providing easy access to the food within the packaging after purchase, conveying information about the food to consumers and attracting the attention of consumers to increase the likelihood that they will purchase the food.

Some food packaging includes a paper or cardboard container with a plastic lid. To allow for easy stacking, the plastic lids have relatively flat tops with at most a raised outside ridge line along the perimeter and perhaps a slightly raised logo on the interior of the lid. Because food packaging is placed on shelving, most of the packaging is viewed from a side angle. As a result, consumers are not given a good view of the lids when shopping. Because of this, the lids have not performed well at attracting the attention of consumers. In addition, the relatively flat lids are not ideal at conveying information to the consumer because the text or logo information on the lid is not presented in such a way as to be readily apparent to the consumer. In particular, since most plastic lids are a single color, the text and logo information tends to be difficult to differentiate from the other parts of the lid unless the consumer is specifically looking for the logo or text.

The discussion above is merely provided for general background information and is not intended to be used as an aid in determining the scope of the claimed subject matter.

SUMMARY OF THE INVENTION

A food package has a container and a lid. The lid includes a planar surface and a convex dome that is above the planar surface. A transparent window in the convex dome attracts the attention of consumers since it is raised relative to the remainder of the lid. The lid also includes a concave dome that frames a raised logo or raised text within the dome. By framing the logo, the concave dome helps to direct a consumer's attention to the logo or text and helps to protect the logo or text from wear.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Embodiments described herein provide a food container with a lid for distributing, marketing, and consuming food products. For example, the packaging is well suited for use with dry cereal. The lid includes structures that attract consumers' attention and that help to convey information to the consumer. Under one particular embodiment, the structures include a convex dome with a clear window that rises above the remainder of the lid so that it can be seen easily by consumers passing a shelf containing the food package. The visible clear window on the dome encourages consumers to try to look through the window to see if they can view the contents of the packaging. Thus, the consumer's attention is drawn to the packaging by the clear window. Under further embodiments, logo and text information is framed by placing the logo or text in a concave dome, which draws the consumer's attention to the logo or text. This makes it easier for the lid to convey the information represented by the logo or text to the consumer. This concave dome has the added benefit of protecting the logo or text from abrasion, thereby improving its ability to convey information to the consumer.

In the discussion below, relative placement terms such as above, below, raised, lowered, top, bottom, front, back, and side are used. These terms are to be understood as being relative to the orientation of the structures shown in the attached drawings and relative to each other.

Figure 1:
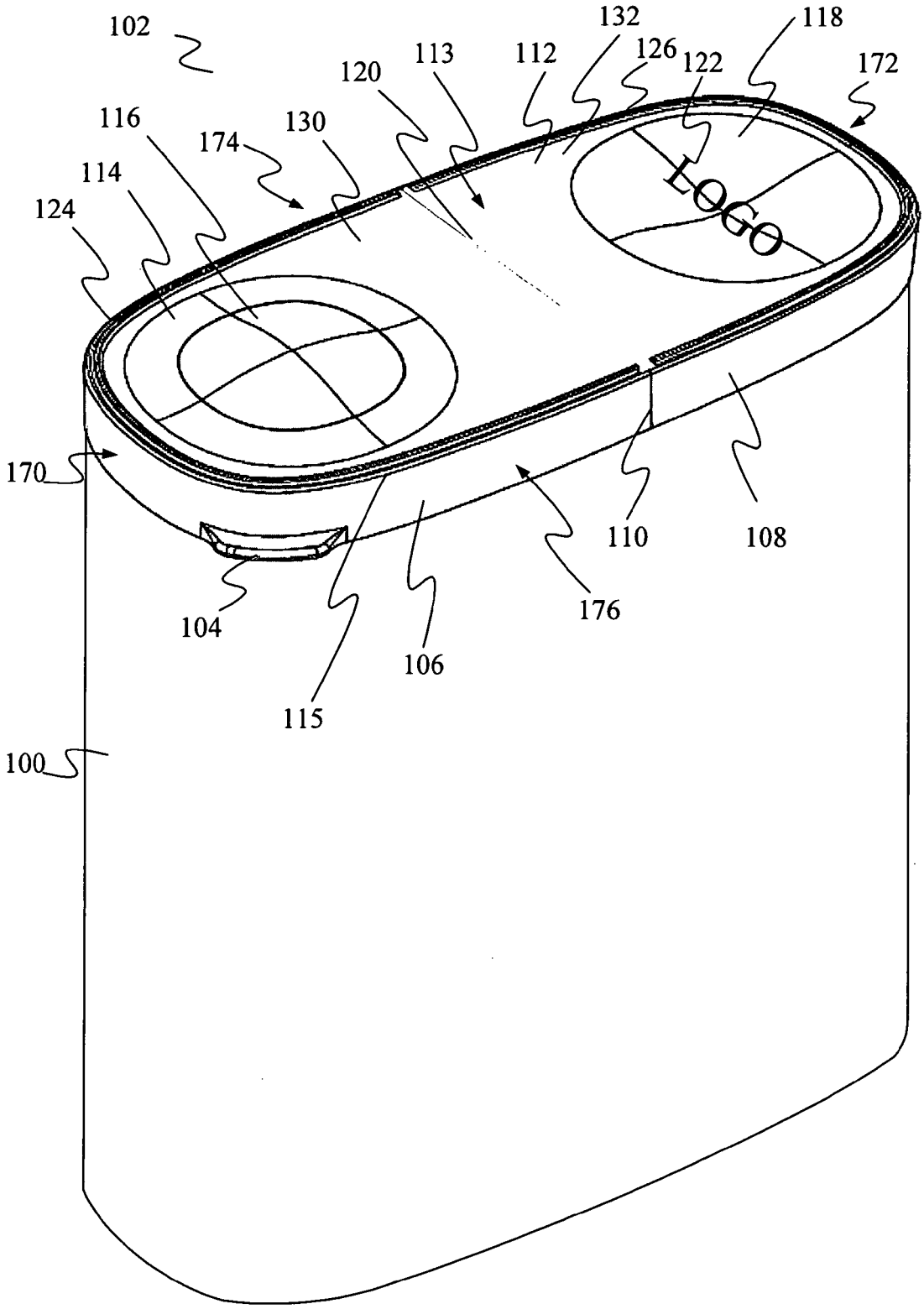
FIG. 1 is a perspective view of a food container with lid, under one embodiment.

FIG. 1 provides a perspective view of a container 100 with a lid 102 used to contain food products. Lid 102 includes a front 170, a back 172, a side 174 and an opposite side 176. Lid 102 also includes a top area or region 112 that has a periphery 115 contiguous with and defined by skirts 106 and 108 that are separated by a slit 110.

Top area 112 includes a planar region or surface 113 that surrounds a concave or depressed area 118 and a convex or raised area 114 having a window 116. In the embodiment of FIG. 1, convex area 114 and concave area 118 are both oval shaped domes. However, in other embodiments, other shapes may be used for the convex and concave areas such as squares, triangles, pentagons and octagons, for example. In some of the Figures, lines are shown crossing convex area 114 and concave area 118 to provide a sense of the shapes of these areas. However, such lines are not present in the actual lid.

Planar region 113 includes a hinge area 120 that is aligned with slit 110 and that extends from side 176 to side 174 between convex area 114 and concave area 118. The portion of lid 102 between hinge area 120 and front 170 is referred to herein as front portion 180 and the portion of lid 102 between hinge area 120 and back 172 is referred to herein as back portion 182

Figure 2:
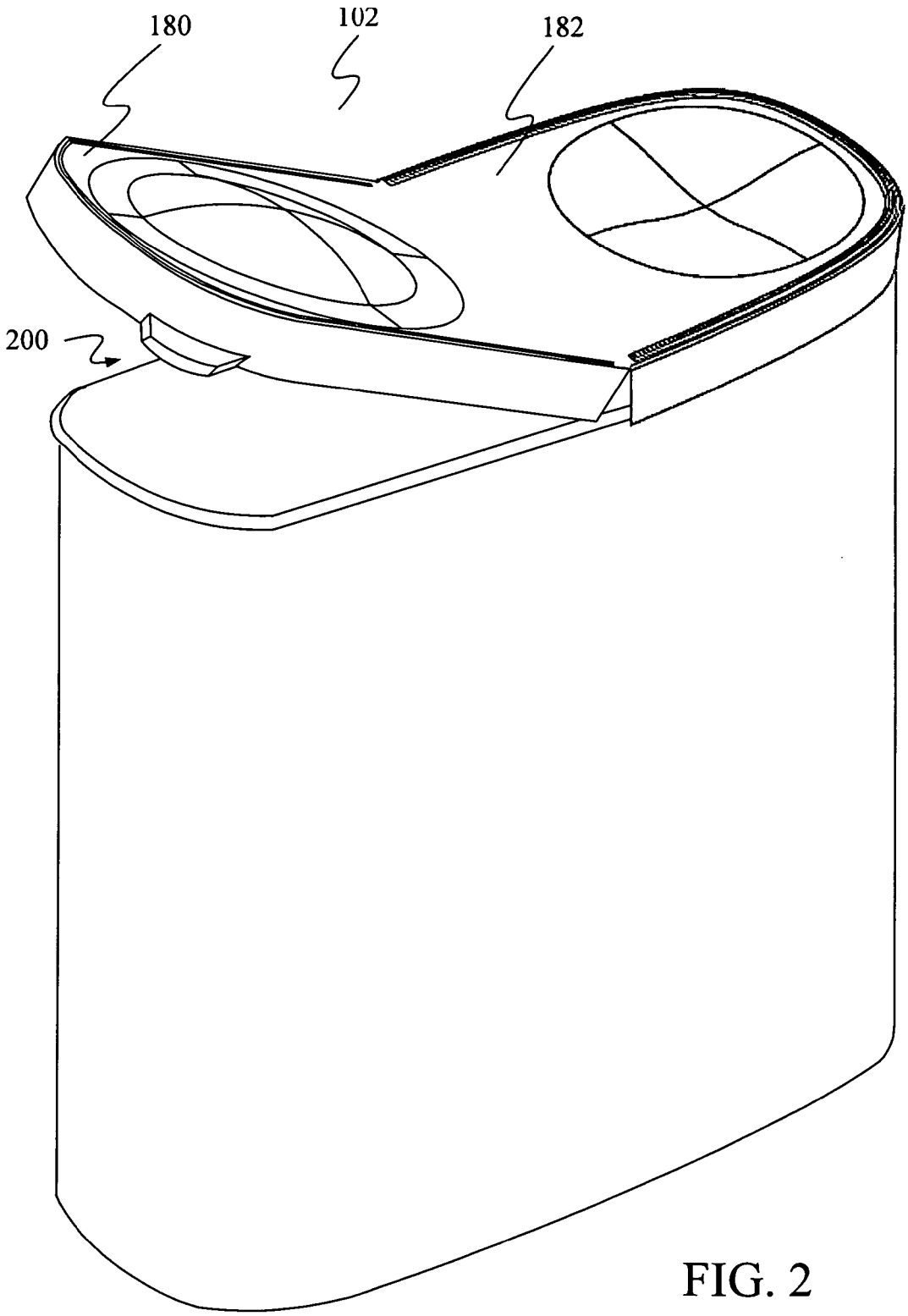
FIG. 2 is a perspective view of a lid and container with the lid hinged open under one embodiment.

By lifting on tab 104, a user is able to separate skirt 106 from skirt 108 along slit 110 by bending planar surface 113 along hinge area 120 as shown in FIG. 2. In FIG. 2, front portion 180 of the lid is detached from container 100 and is hinged relative to back portion 182, while back portion 182 remains attached to container 100. When lid 102 is hinged open in this configuration, an opening 200 is created between front portion 180 and container 100. The contents within container 100 may be extracted from container 100 by reaching into the container or by pouring the contents out of the container through opening 200.

Near periphery 115 of top area 112 are a ridge 124 on front portion 180 and a ridge 126 on back portion 182 which each terminate before hinge area 120. Under some embodiments, terminating before hinge area 120 includes terminating at the boundary of hinge area 120. Ridges 124 and 126 are raised relative to planar surface 113 but are not raised as high as the top of window 116 in convex dome 114. Ridges 124 and 126 provide a structure for fitting within the underside of another container that is stacked on top of lid 102 during shipping or during retail display.

Ridge 124 and hinge area 120 together define an interior region 130 on top area 112, where convex area 114 is located within interior region 130. Ridge 126 and hinge area 120 together define a second interior region 132 on top area 112, where concave area 118 is located within second interior region 132.

Concave area 118 includes a raised logo or text 122 that is formed as part of the lid and is raised relative to the surface of the concave area 118 but is below planar surface 113. Concave area 118 thereby frames logo 122, drawing the user's attention to the logo while also protecting the logo from wear.

Convex area 114 raises window 116 above planar surface 113 and ridges 124 and 126. Under one embodiment, window 116 is clear or transparent so that objects below lid 102 can be viewed from above lid 102. By raising this window above ridges 124 and 126, consumers can see the window when passing a display that contains the package. This allows consumers to notice that the dome is clear and thereby invites them to come closer to the packaging to view the contents below the window.

Figure 3:
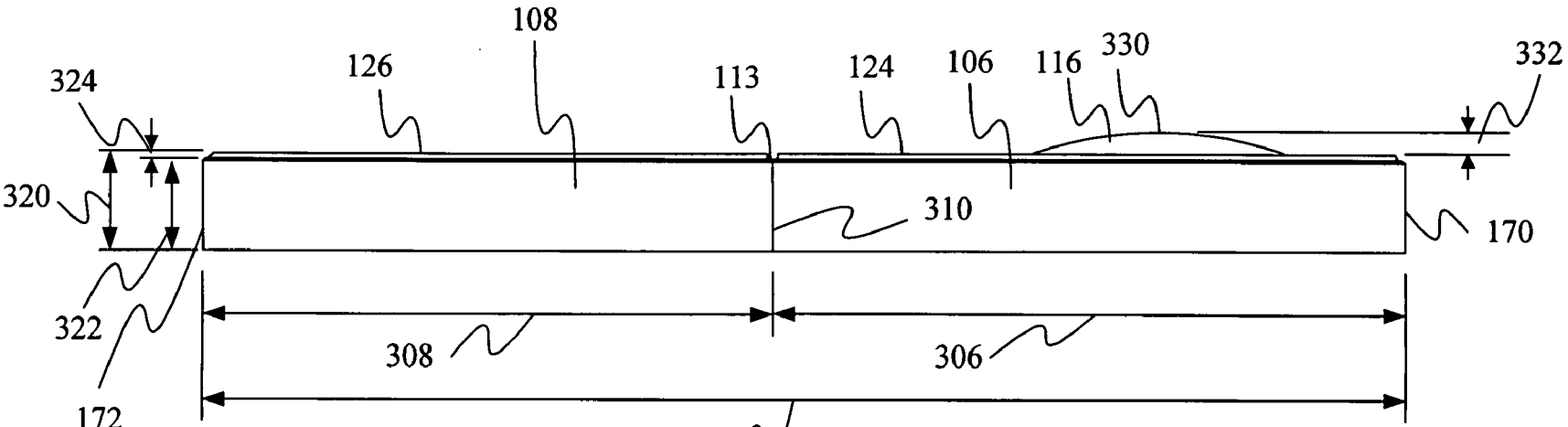
FIG. 3 is a side view of a lid under one embodiment.
Figure 4:
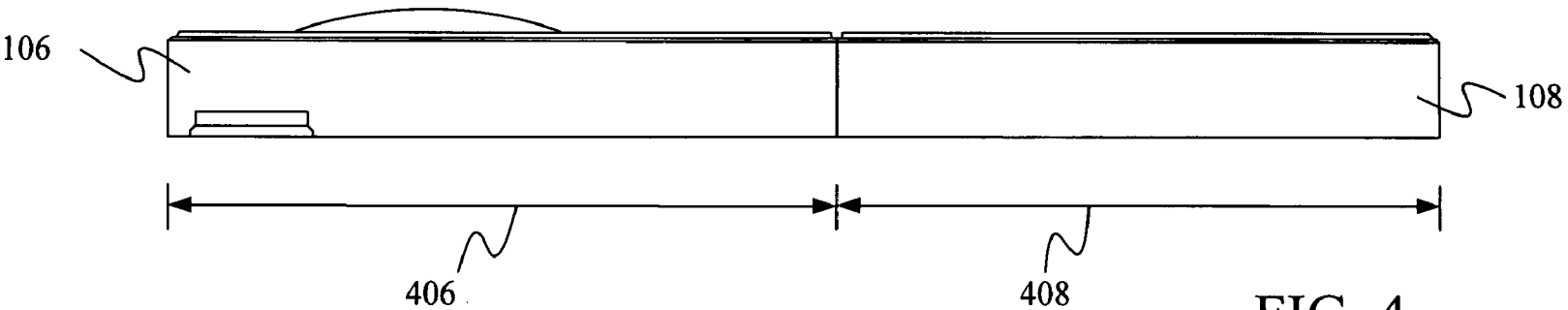
FIG. 4 is an opposite side view of the lid of FIG. 3.

FIGS. 3 and 4 show side views of lid 102. The side view of FIG. 3 shows skirt 106 and skirt 108 separated by a slit 310 and the side view of FIG. 4 shows skirt 106 and skirt 108 separated by slit 110. Lid 102 has a length 300 measured from front end 170 to back end 172, which under one embodiment is 6.15 inches. Skirt 106 has a length 306 from front end 170 to slit 310 and skirt 108 has a length 308 from slit 310 to back end 172. Under one embodiment, length 306 is 3.193 inches and length 308 is 2.957 inches. As such, slit 310 is not centered between front end 170 and back end 172. In FIG. 4, skirt 106 has a length 406 and skirt 108 has a length 408 that are the same as lengths 306 and 308, respectively. However, in other embodiments, length 406 may be different from length 306 resulting in a hinge area that runs diagonally across lid 102.

Lid 102 has a height 320 from the bottom of skirt 108 to the top of ridge 126. This height is the same as the height from the bottom of skirt 106 to the top of ridge 124. Under one embodiment, height 320 is 0.51 inches. Planar surface 113 is a height 322 from the bottom of skirt 108 and skirt 106. Under one embodiment, height 322 is 0.479 inches. The tops of ridges 124 and 126 are a height 324 above planar surface 113. Under one embodiment, height 324 is 0.031 inches.

Convex clear window 116 has a top 330 that is a height 332 above the top of ridge 124. Under one embodiment, height 332 is 0.125 inches. Because convex window 116 is above the top of ridge 124, it can be viewed by consumers even when the top of the lid is level with the consumer's eyes or above the consumer's eyes slightly. This allows consumers to recognize that lid 102 has a clear window through which items below the lid may be viewed.

Figure 5:
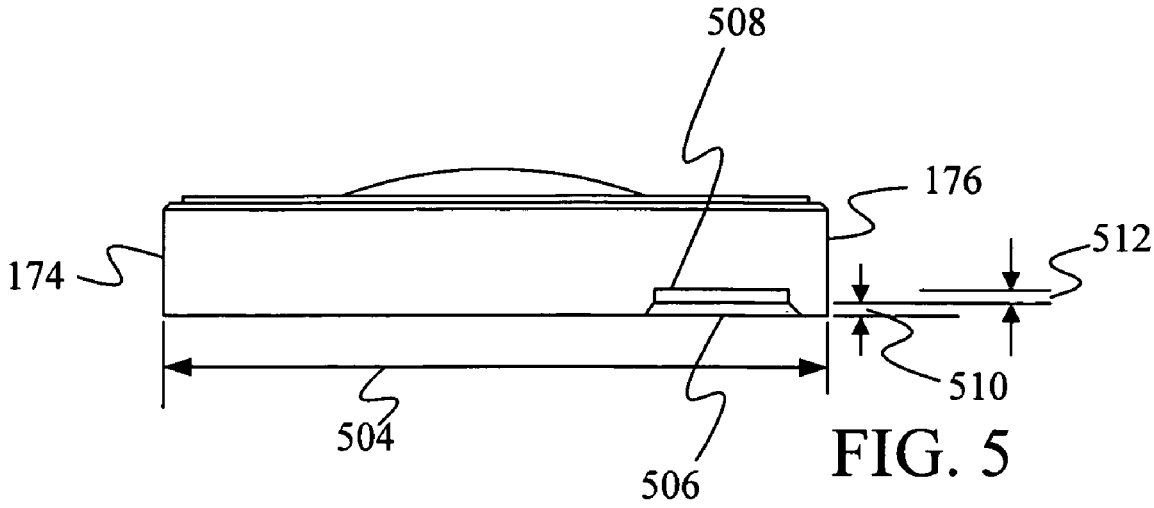
FIG. 5 is a front view of the lid of FIG. 3.
Figure 6:
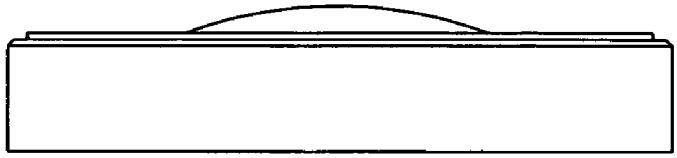
FIG. 6 is a back view of the lid of FIG. 3.

FIGS. 5 and 6 show a front view and a back view, respectively, of lid 102. Lid 102 has a width 504 from side 174 to side 176. Under one embodiment, width 504 is 2.656 inches.

In FIG. 5, tab 104 is shown as having a base portion 506 and a crown portion 508. Base portion 506 has a height 510 and crown portion 508 has a height 512. Under one embodiment, heights 510 and 512 are 0.06 inches each.

Figure 7:
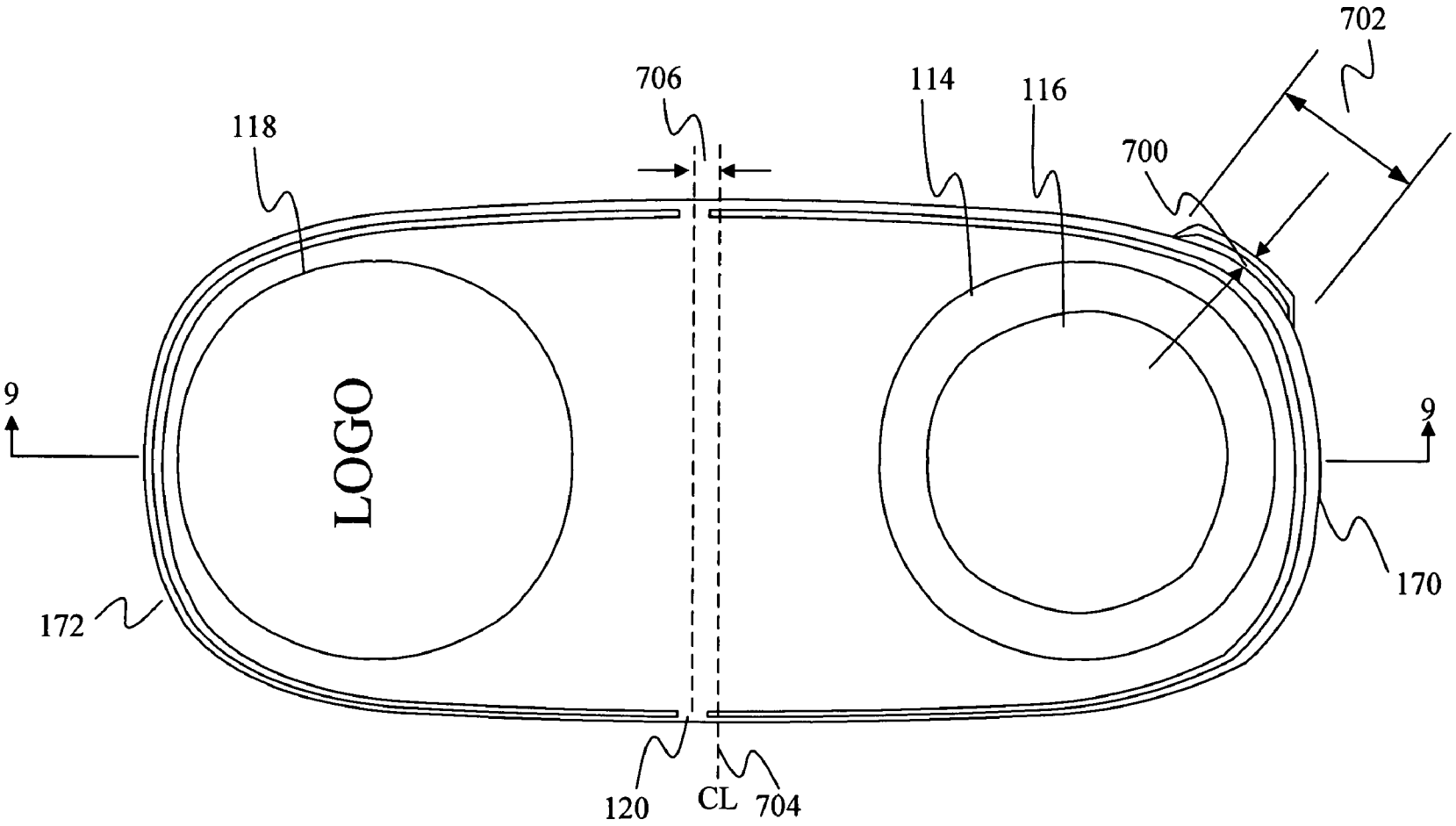
FIG. 7 is a top view of the lid of FIG. 3.
Figure 8:
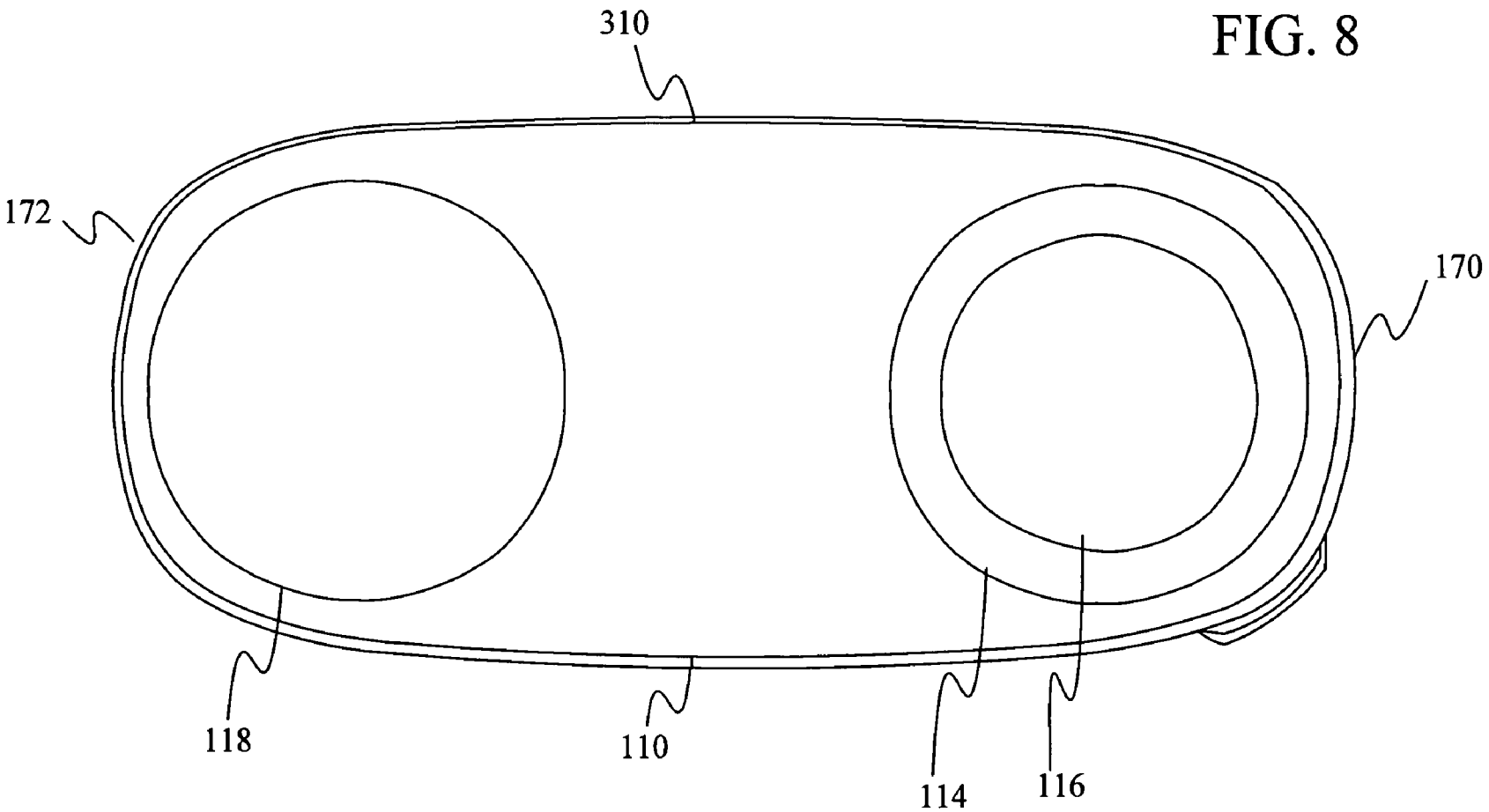
FIG. 8 is a bottom view of the lid of FIG. 3.

FIGS. 7 and 8 show a top view and a bottom view, respectively, of lid 102. In the embodiment of FIG. 7, lid 102 has an oval shape. In other embodiments, lid 102 may have a square or rectangular shape. In FIG. 7, tab 104 is shown to extend out from lid 102 by a distance 700, which under one embodiment is 0.1 inches. The tab extends along a distance 702, which under one embodiment is 0.9 inches.

Convex area 118 has an oval periphery. This oval periphery may be circular or consist of a set of different radial arcs. Similarly, convex area 114 and window 116 have an oval shape that may also be either circular or some other oval construct. In one particular set of embodiments, convex area 114 and concave area 118 are ovals defined by radii between 1.0312 inches and 1.0625 inches and window 116 is an oval defined by radii between 0.6875 inches and 0.71875 inches that is located concentrically within the oval that defines the periphery of convex area 114. In other embodiments, convex area 114 and concave area 116 may have a non-oval periphery. Under one embodiment, convex area 114 and concave area 118 have equal circumferences.

In FIG. 7, hinge area 120 is shown offset from a center line 704 by a distance 706, which under one embodiment is 0.118 inches. Center line 704 is halfway between front end 170 and a back end 172 of the lid.

Figure 9:
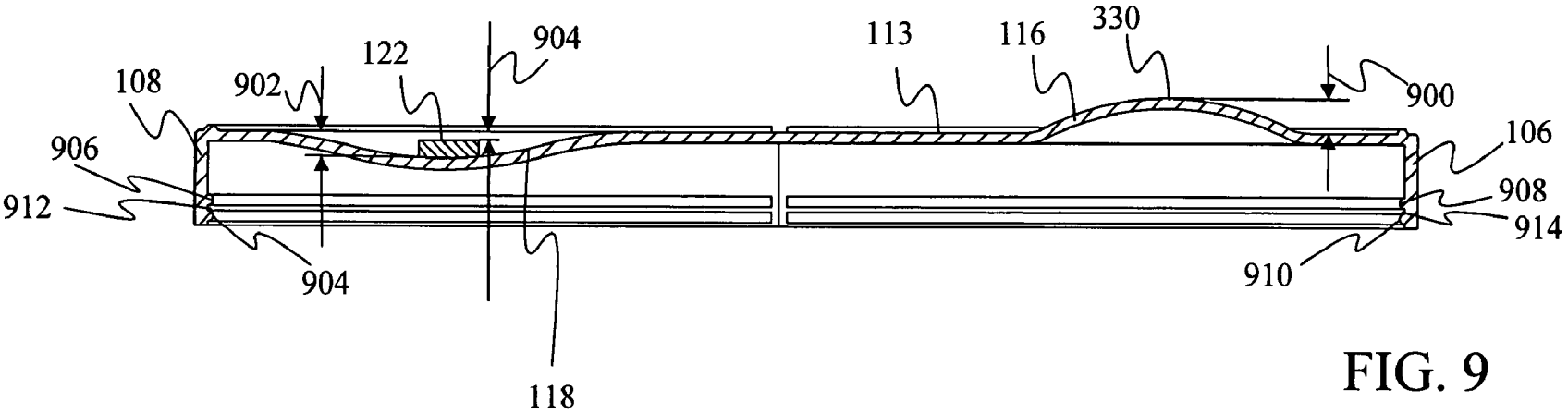
FIG. 9 is a cross sectional view of a lid of one embodiment.

FIG. 9 provides a cross-sectional view of lid 102 along lines 9-9 of FIG. 7. In FIG. 9, the top 330 of window 116 is shown to be a height 900 above planar surface 113. Under one embodiment, height 900 is 0.14 inches. Similarly, the top surface of the lowest point of concave area 118 is shown to be a distance 902 below planar surface 113. Distance 902 under one embodiment is 0.14 inches. Logo 122 is shown in concave area 118 to be raised relative to the top surface of concave area 118. However, the height of logo 122 is a distance 904 below planar surface 113. As a result, logo 122 is somewhat protected from contact.

Figure 10:
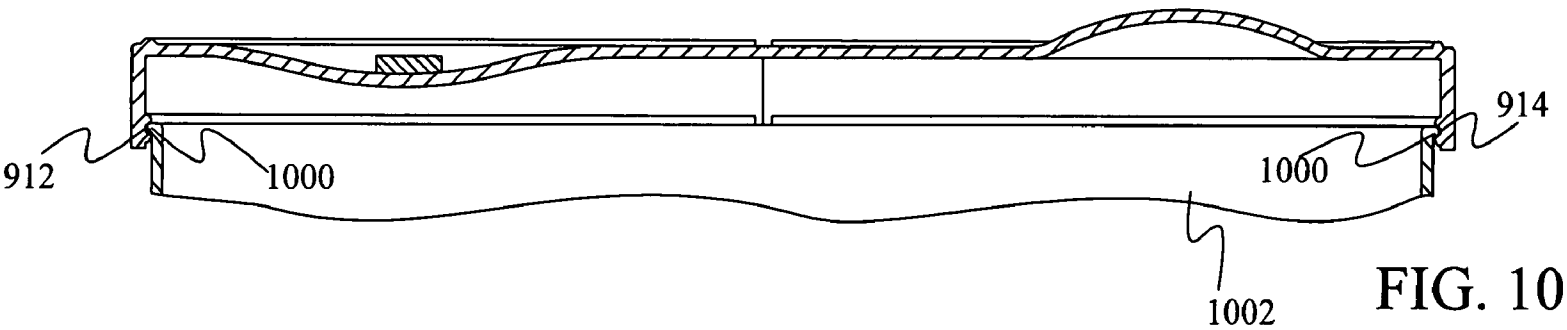
FIG. 10 is a cross-sectional view of a lid and container of one embodiment.

Skirt 106 is shown to include ribs 908 and 910 and skirt 108 is shown to include ribs 904 and 906. Ribs 908 and 910 extend around skirt 106 and terminate just before or at slit 110 and slit 310. Ribs 904 and 906 extend around skirt 108 and terminate just before or at slit 110 and slit 310. Ribs 904 and 906 define a groove 912 and ribs 908 and 910 define a groove 914. A lip of a container fits into grooves 912 and 914 to secure lid 102 to container 100 as shown in FIG. 10. In particular, in FIG. 10, lip 1000 formed on the outer circumference of the top of a container 1002 engages in grooves 912 and 914 and thus holds lid 102 in place on container 1002.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A container lid comprising:

at least one skirt capable of engaging a portion of a container; and a top area having a periphery contiguous with the at least one skirt, the top area being configured to be positioned above the container when the at least one skirt engages the portion of the container, the top area comprising:

a planar region;

a ridge that is raised relative to the planar region and that in part defines an interior region of the top area;

a convex area, having a clear window that is raised relative to and extends above the ridge, wherein the convex area is positioned in the interior region defined in part by the ridge and is entirely surrounded by the planar region; and a concave area, wherein the concave area has a circumference that is equal to a circumference of the convex area.

2. A container lid comprising:

at least one skirt capable of engaging a portion of a container; and a top area having a periphery contiguous with the at least one skirt, the top area being configured to be positioned above the container when the at least one skirt engages the portion of the container, the top area comprising:

a planar region, a ridge that is raised relative to the planar region and that in part defines an interior region of the top area, a convex area, having a clear window that is raised relative to and extends above the ridge, wherein the convex area is positioned in the interior region defined in part by the ridge and is entirely surrounded by the planar region, a concave area, and a raised logo located within the concave area.

3. The container lid of claim 2 wherein the top of the raised logo is below the planar region of the top area.

4. A container lid comprising:

at least one skirt capable of engaging a portion of a container; and a top area having a periphery contiguous with the at least one skirt, the top area being configured to be positioned above the container when the at least one skirt engages the portion of the container, the top area comprising:

a planar region, a ridge that is raised relative to the planar region and that in part defines an interior region of the top area, a convex area, having a clear window that is raised relative to and extends above the ridge, wherein the convex area is positioned in the interior region defined in part by the ridge and is entirely surrounded by the planar region, and the window is concentric within the convex area, and a concave area.

5. A lid comprising:

a planar region;

a depressed area surrounded by the planar region;

a raised logo located within the depressed area such that the top of the raised logo is below the planar region; and a raised area surrounded by the planar region such that the raised area is above the planar region;

wherein:

the raised area comprises a transparent region that allows objects below the lid to be viewed from above the lid, the raised area comprises a convex dome, the transparent region comprises an area that is concentric with the convex dome, and the lid further comprises a ridge around at least a portion of the planar region and raised relative to the planar region, at least a portion of the transparent region being above the ridge.

6. The lid of claim 5 wherein the depressed area comprises a concave dome.

7. The lid of claim 6 wherein the raised area comprises a convex dome.

8. The lid of claim 7 wherein the concave dome and the convex dome have equal circumferences.

9. A food package comprising:

a container having a lip, the container containing a food product;

a lid comprising:

at least one skirt having a groove for accepting the lip of the container to hold the lid in position on the container, the at least one skirt defining a slit;

a top region having a periphery bounded at least in part by the at least one skirt, the top region comprising:

a planar surface;

a ridge that is above the planar surface;

a convex dome that is above the ridge and the planar surface and comprises a clear window;

a concave dome that is below the planar surface;

a raised logo within the concave dome that is below the planar surface; and a hinge extending across the planar surface and aligned with the slit defined by the at least one skirt, the hinge and the slit collectively dividing the lid into a first portion and a second portion, the first portion being selectively rotatable about the hinge relative to the second portion.

10. The food package of claim 9 wherein the convex dome and the concave dome have equal circumferences.

11. The food package of claim 9, wherein:

each of the lip of the container and the lid is oblong, the lid defines opposing ends, the convex dome and the concave dome are each positioned at a different one of the opposing ends of the lid, and the hinge extends transversely between the convex dome and the concave dome such that one of the convex dome and the concave dome is positioned on the first portion of the lid and the other of the convex dome and the concave dome is positioned on the second portion of the lid.

12. A container lid comprising:

at least one skirt capable of engaging a portion of a container; and a top area having a periphery contiguous with the at least one skirt, the top area being configured to be positioned above the container when the at least one skirt engages the portion of the container, the top area comprising:

a planar region, a ridge that is raised relative to the planar region and that in part defines an interior region of the top area, a convex area, having a clear window that is raised relative to and extends above the ridge, wherein the convex area is positioned in the interior region defined in part by the ridge and is entirely surrounded by the planar region;

wherein:

the at least one skirt and the top area are each oblong, the top area defines an overall length and an overall width that is less than the overall length, the convex area and the concave area each define a center, and the center of the convex area and the center of the concave area are spaced apart a distance from one another that is greater than the overall width of the top area.

13. The container lid of claim 12, wherein:

the at least one skirt includes a first skirt and a second skirt separated by a slit, the planar region defines a hinge area aligned with the slit, the hinge extending across the overall width of the top area and being positioned between the convex area and the concave area, and while the second skirt engages the portion of the container, the first skirt, a portion of the planar area, and one of the convex area and the concave area are configured to rotate about the hinge area away from the container.

14. The container lid of claim 13, in combination with the container, wherein:

the portion of the container includes an upper lip, the first skirt and second skirt selectively engage the upper lip of the container to couple the container lid to the container, and while the second skirt engages the upper lip of the container, the first skirt, a portion of the planar area, and one of the convex area and the concave area are configured to rotate about the hinge area away from the upper lip of the container.

* * * * *